US005166576A

United States Patent [19]

Roussel et al.

[11] Patent Number: 5,166,576

[45] Date of Patent: Nov. 24, 1992

[54] DEFLECTION YOKE ARRANGEMENT WITH OVERLAPPING DEFLECTION COILS

[75] Inventors: Bruno Roussel; Didier Thibaudin, both of Genlis, France

[73] Assignee: Videocolor S.A., Paris, France

[21] Appl. No.: 700,719

[22] Filed: May 17, 1991

[30] Foreign Application Priority Data

May 18, 1990 [EP] European Pat. Off. ..... 90401336.4

[51] Int. Cl.[5] ..... H01J 29/76

[52] U.S. Cl. ..... 313/431; 313/440

[58] Field of Search ..... 313/440, 431

[56] References Cited

U.S. PATENT DOCUMENTS

| | | | |
|---|---|---|---|
| 3,424,942 | 1/1969 | Barbin | 313/440 X |
| 4,524,340 | 6/1985 | Sluyterman | 335/212 |
| 5,049,847 | 9/1991 | Okuyama et al. | 313/440 X |

OTHER PUBLICATIONS

U.S. patent application Ser. No. 786,623, Priere et al, Filing date, May 17, 1991.

*Primary Examiner*—Palmer C. DeMeo

*Attorney, Agent, or Firm*—Joseph S. Tripoli; Joseph J. Laks; Francis A. Davenport

[57] ABSTRACT

A deflection coil system for a picture tube has a primary deflection coil and an auxiliary deflection coil. The primary and auxiliary deflection coils are each operable to produce a respective magnetic field having a first polarity within a region defined by the coil and an opposite polarity in a second region. Each of the two coils is arranged such that part of the positive polarity field of each coil and all of its opposite polarity field, are in each case coupled to the other coil. This cancels the effects of cross coupling of the primary and auxiliary deflection coils, which are placed in proximity to each other on the same axis, for example on the neck and envelope of a television display tube. At least one of the primary and auxiliary deflection coils may be a saddle shaped deflection coil and has a flat end turn section, substantially defining the opposite polarity area. The primary and auxiliary deflection coils are overlapped on the tube over at least part of this end turn section.

25 Claims, 2 Drawing Sheets

FIG. 1
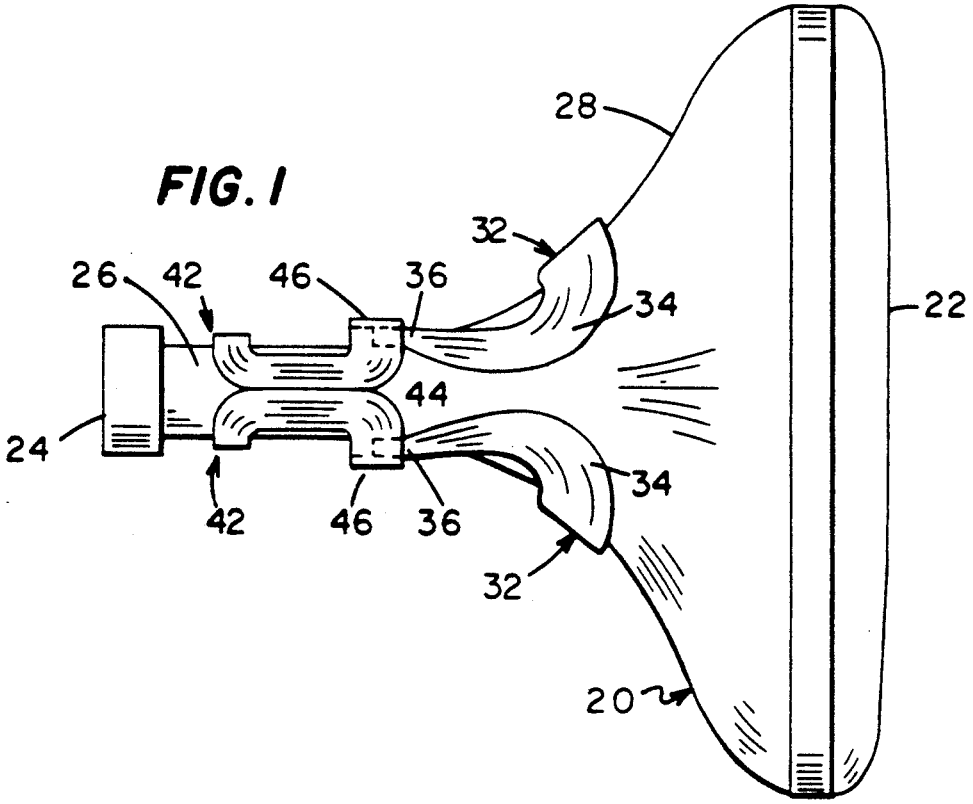
FIG. 2
PRIOR ART
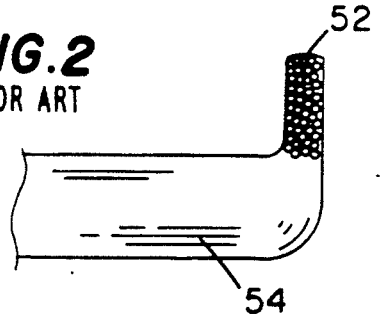
FIG. 3
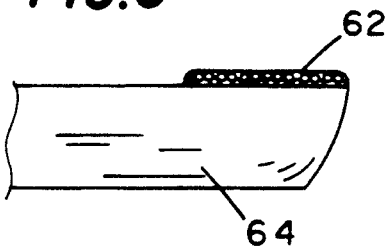
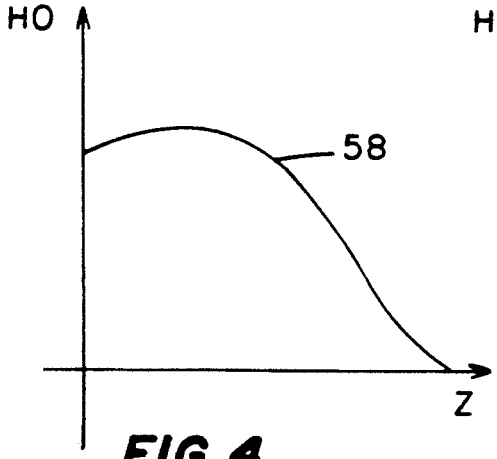
FIG. 4
PRIOR ART
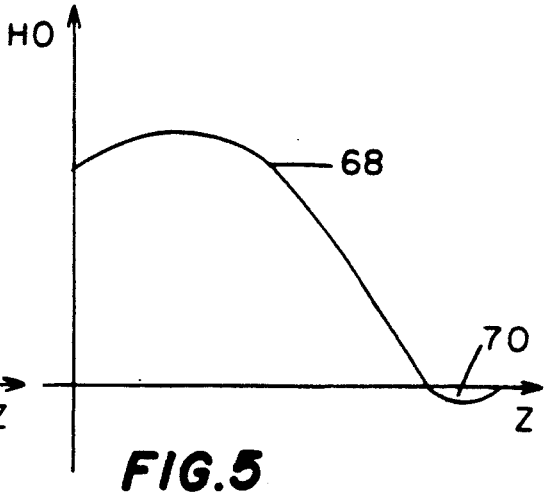
FIG. 5

FIG. 6
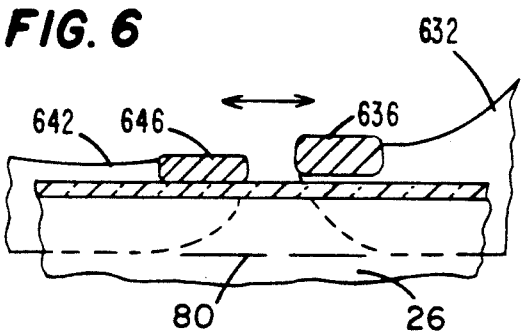
FIG. 8
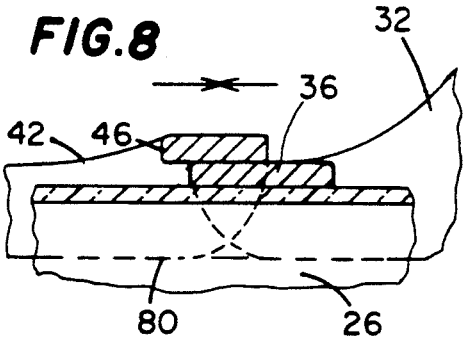
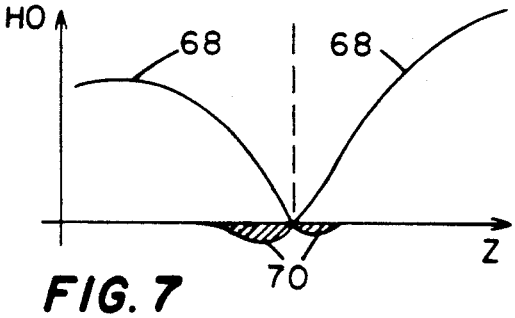
FIG. 7
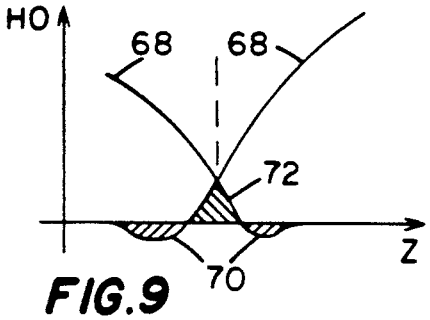
FIG. 9
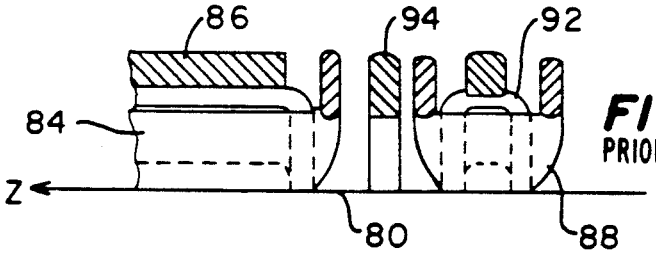
FIG. 10
PRIOR ART
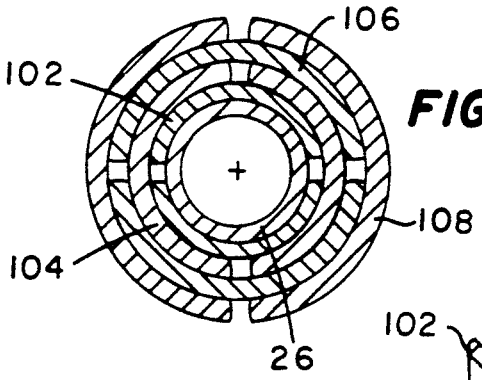
FIG. 12
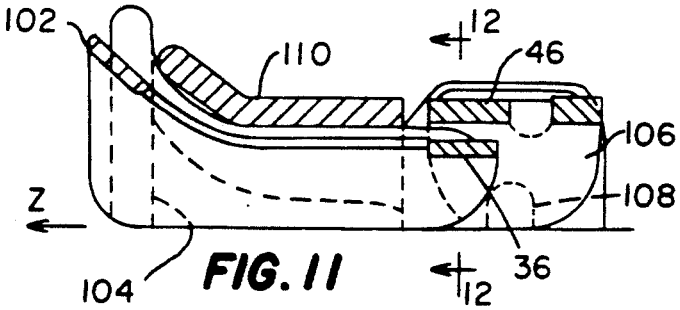
FIG. 11

DEFLECTION YOKE ARRANGEMENT WITH OVERLAPPING DEFLECTION COILS

This invention relates to the field of deflection yokes for electromagnetic deflection of scanned electron beams, wherein a main yoke section is provided for primary deflection of the beams and an auxiliary yoke section accomplishes a secondary deflection function. In particular, the invention concerns main and auxiliary yoke sections which are overlapped in a manner effective to null adverse effects of cross coupling between the main and auxiliary coils.

BACKGROUND OF THE INVENTION

Deflection yokes for television picture tubes comprise pairs of conductor coils on opposite sides of the tube, which are energized with a current for producing a magnetic field having field lines intersecting the electron beam path, the field lines being disposed perpendicular to the beam path. It is known to employ main and auxiliary deflection yokes in a television apparatus. A main yoke section provides a large amplitude electromagnetic deflection of the beam for scanning in the horizontal and vertical directions as needed to define a raster.

An auxiliary yoke section can accomplish a number of additional functions, including, for example, improving the convergence of the individual red, blue and green electron beams in a color television project apparatus. An auxiliary deflection yoke can be provided for defining alphanumeric characters at a position in the raster determined by the main deflection yoke, using a vector scanning of the beam at the desired position. Another possibility is an auxiliary yoke for modulating the beam scan as a function of the video so as to control contrast, which is modulated by the beam scan velocity.

An auxiliary yoke provides a deflection of a smaller amplitude than the main deflection yoke, and can provide deflection at high speed. The auxiliary deflection yoke is placed to the rear of the primary deflection yoke, between the electron guns and the primary deflection yoke.

The magnetic field produced by a coil naturally has a magnetic field intensity that extends spatially from the area of the conductors defining the coil. The field decreases in amplitude with distance from the coil conductors, i.e., with distance along the Z axis. To minimize coupling between an auxiliary deflection coil and a primary deflection coil on the same axis, it is possible to space the auxiliary and primary coils from one another along the Z axis. However, the length of the picture tube is thereby increased. In addition to the physical length of the deflection coils along the Z axis, the operative length of the deflection system as a whole (primary plus auxiliary) determines the focal length of the gun-deflection system, which forms an electron lens. Accordingly, a longer deflection system must be spaced farther from the screen and results in poorer resolution at the screen. A compact deflection yoke arrangement is desirable as it enables a shorter overall tube length.

In a saddle shaped deflection yoke, as shown in Prior Art FIGS. 2 and 10 of the drawings, the ends of the yoke at the axial extremes along the tube are formed such that the windings are superimposed to protrude radially of the tube. In this manner, the magnetic field proceeding axially along the tube is more sharply cut off at the axial end than occurs if the windings at the axial end are superimposed axially along the tube. As shown in Prior Art FIG. 4, the magnetic field intensity proceeding axially tail off to near zero when passing the axial end of a saddle shaped coil of this type. A saddle shaped coil of the type shown in FIGS. 2 and 10 has heretofore been preferred.

It is also possible to provide a high permeability magnetic shunt between the auxiliary coils and the primary coils, e.g., a ferrous ring having a minimum extension along the Z axis as shown in FIG. 10. The magnetic field lines are confined to the high permeability shunt path, tending to localize the fields produced by the respective coils and to better isolate the effects of the primary deflection coils and the auxiliary deflection coils. Notwithstanding these efforts, some coupling of the primary and auxiliary deflection coils remains, in part through the high permeability shunt. Accordingly, modulation of the auxiliary deflection coils by the primary deflection signals (and vice-versa) causes auxiliary deflection to vary with the position of the beam in the raster, and adversely affect convergence and color purity.

SUMMARY OF THE INVENTION

It is an aspect of the present invention to eliminate cross-modulation between the primary and auxiliary deflection coils of a scanning electron beam apparatus, by providing at least one coil with a magnetic field section of negative polarity, and deliberately coupling the two coils using the negative polarity sections to null the effects of coupling at positive polarity.

It is also an aspect of the invention to reduce the dimensions along the Z axis of a deflection system having primary and auxiliary deflection coils, by enabling the coils to be placed close behind one another and preferably overlapping one another, with cross-modulation resulting from the proximity of the coils cancelled.

It is a further aspect of the invention to provide a particular form of deflection coil which produces a reversed polarity field at one end, whereby positive cross coupling of the coils can be nulled by cross coupling the reversed polarity fields in addition to cross coupling the main coil fields.

These and other aspects are found in a deflection coil system for an electron beam apparatus having a primary deflection coil and an auxiliary deflection coil. The primary and auxiliary deflection coils are each operable to produce a respective magnetic field having a first polarity within an area defined by the coil and an opposite polarity in a second area. Each of the two coils is arranged such that part of the positive polarity field of each, and all of its opposite polarity field at one end, are in each case coupled to the other coil, thereby cancelling the effects of cross coupling of the primary and auxiliary deflection coils, which are placed in proximity on the same axis, for example on the neck and envelope of a television display tube. In an advantageous arrangement, at least one of the primary and auxiliary deflection coils is a saddle shaped deflection coil and has a flat end turn section, at substantially defining the opposite polarity area. The primary and auxiliary deflection coils are overlapped on the tube over at least part of this section.

Advantageously, both the primary deflection coil and the auxiliary deflection coil have such a flat end turn section, the sections of each coil being disposed on the axial end thereof directed toward the other coil, and the two coils being at least partly overlapped. The auxiliary deflection coil can be a saddle shaped coil dimensioned for mounting on a neck of a cathode ray tube, and the primary deflection field can be a flaring saddle shaped coil that extends along the neck and onto the funnel or flaring section of the tube.

BRIEF DESCRIPTION OF THE DRAWINGS

FIG. 1 is an elevation view of a deflection coil system according to the invention, only the horizontal deflection coils being shown;

FIG. 2 is a partial section view through an axial end of a different type of deflection coil;

FIG. 3 is a partial section view through an axial end of a deflection coil according to the invention;

FIG. 4 is a graph showing magnetic field intensity versus displacement on the Z axis, characteristic of the deflection coil of FIG. 2;

FIG. 5 is a graph showing magnetic field intensity versus displacement on the Z axis, characteristic of the deflection coil according to the invention, namely as shown in FIG. 3;

FIG. 6 is a partial section view through axial ends of two deflection coils, on the same axis and in a first position;

FIG. 7 is an H vs. Z graph corresponding to FIG. 6;

FIG. 8 is a partial section view as in FIG. 6, wherein the axial ends are arranged to overlap;

FIG. 9 is an H vs. Z graph corresponding to FIG. 8;

FIG. 10 is a partial section view through a modified version of the deflection coil arrangement of FIG. 2;

FIG. 11 is a partial section view through a full deflection yoke arrangement according to the invention; and, FIG. 12 is a section view taken along lines 12—12 in FIG. 11.

DETAILED DESCRIPTION

FIG. 1 illustrates a deflection coil system for an electron beam apparatus in the form of a television picture tube 20. Electrons produced by one or more electron guns disposed at the rear 24 of the picture tube 20 are accelerated toward viewing screen 22, which bears phosphors on an inner surface, to be excited by the electrons and thereby produce a visual display. The electrons are accelerated along a longitudinal or Z electron beam axis, substantially along a center line of the tube 20, and with deflection caused by operation of the deflection coils, through neck 26 and funnel shaped envelope 28. The electron beam is deflected magnetically for scanning on the screen to e.g. obtain a raster, when deflection is performed in a raster scanning mode.

Magnetic fields are produced via deflection coils placed on the neck 26 and partly on the funnel shaped envelope 28 of the tube 20. In FIG. 1, only the horizontal deflection coils are shown, however, vertical deflection coils are also provided, as explained in more detail hereinafter. The coils for each axis of the field are provided in pairs, one on each side of the tube.

For obtaining horizontal deflection for line scanning, primary horizontal coils 32 are disposed on opposite sides of tube 20. Primary horizontal coils have windings 34 which define loops oriented generally in a horizontal plane. Accordingly, the magnetic field produced by coils 32 has field lines disposed generally vertically across the path of the electron beam. The coils are energized by a sawtooth current at the horizontal line scanning frequency, and therefore cause the electron beams to trace horizontal lines on screen 22. Similarly, primary vertical deflection coils (not shown in FIG. 1) define loops disposed generally vertically, producing field lines oriented generally horizontally, and deflect the electron beam vertically at the vertical scanning rate.

Typically, the horizontal and vertical primary deflection coils are mounted together in a deflection yoke having an external housing (not shown) and residing on the neck 26 at its junction with the funnel shaped envelope, 28, such that the forward portion of the deflection coils extend onto the funnel 28. Preferably, the deflection yoke is as short as possible along the Z axis (the tube center line), such that the focal length of the deflection system, which defines a magnetic lens, is short and the overall length of the apparatus is minimal. The deflection yoke itself is formed of a plurality of individual conductors and may include a high permeability body or core, not shown in FIG. 1, for example of ferrite, for confining flux leakage.

The auxiliary deflection coil system is provided according to the invention to produce any of a number of additional deflections that may be desirable, as stated previously. The auxiliary deflection coils 42 are provided to the rear of the primary deflection coils 32. FIG. 1 illustrates horizontal auxiliary deflection coils, however, vertical auxiliary deflection coils may be included to obtain mutually perpendicular magnetic deflection fields. Typically, the amplitude of the auxiliary deflection field is relatively smaller than the amplitude of the primary coils, which provide horizontal and vertical scanning.

A coil having a current passing through it produces magnetic field lines having a first polarity within the loop defined by the coil, and an opposite polarity outside of the loop. Of course in connection with controlled deflection, it is normally desirable to minimize the extent to which the opposite polarity field deflects the electron beam. As shown in FIG. 2, a saddle shaped coil 54 having a laterally protruding section 52 at its axial end along the Z axis can be used to minimize the concentration of the negative polarity field within the tube 20. This configuration provides a magnetic field intensity HO versus Z axis displacement characteristic of curve 58, as shown in FIG. 4, where HO is the main or Gaussian component (i,e. uniform field) of the deflection field.

A more complete depiction of all the respective coils of a primary/auxiliary deflection system that does not have the benefit of the invention is shown in FIG. 10, wherein a high permeability annular disc 94 is disposed between the primary coils and the auxiliary coils. Each of the primary horizontal coil 84, primary vertical coil 86, auxiliary horizontal coil 88 and auxiliary vertical coil 92 has radially directed or turned up end turns.

Inasmuch as the respective coils of a deflection system are disposed along a common axis (the Z axis), some cross coupling occurs notwithstanding efforts to control the positions of the magnetic field lines. Cross coupling is normallly undesirable because the extent of auxiliary deflection is thereby modulated as a function of the position of the beam in the raster, as set by the primary deflection coils.

According to an invention arrangement, however, means are provided to deliberately cross couple the fields of the primary and auxiliary deflection systems in a manner than cancels the effects of the cross coupling.

A primary deflection coil 32 is configured to produce a deflection field having a first polarity within a first region defined by the coil, and an opposite polarity in a second region. The auxiliary deflection coil 42 is also configured to produce a deflection field having a first polarity in a first region and an opposite polarity in a second region. The primary deflection coil 32 and the auxiliary deflection coil 42 are then cross coupled such that the opposite polarity areas of the primary and auxiliary deflection coils cancel cross coupling at the first polarity.

The primary and auxiliary deflection coils 32 and 42 may be deflection coils of a video display tube 20, wherein cross coupling results at least partly from proximity of the primary and auxiliary coils on the tube, the respective coils being disposed on a common Z axis defined by the tube 20. At least one of the primary and auxiliary deflection coils 32 and 42 is a saddle shaped deflection coil, however, a section 62 of the coil as shown in FIG. 3 is a flat end turn at one end of the coil. This configuration produces an HO versus Z curve 68 as shown in FIG. 5. A region 70 occurs along the Z axis, wherein the polarity of the field produced by the coil is opposite from the polarity within the loop of the respective coil. The opposite polarity region corresponds to the elongated section 62 at the axial end of the coil 64.

With reference to FIGS. 6 and 7, two coils 632 and 642, having end turn sections 636 and 646, respectively, are spaced apart and are disposed end to end along a tube 26. The negative polarity section 70 of the deflection field obtained at the axial end of each one of the coils still couples with the positive polarity field of the other coil. The cross coupling is each at the negative polarity, i.e., 180 degrees out of phase. This cross coupling is undesirable because it produces a modulation of the auxiliary deflection as a function of beam position in the raster.

According to an inventive aspect as shown in FIGS. 8 and 9, the primary and auxiliary deflection coils 32 and 42 are juxtaposed so as to be, e.g., overlapped on the tube over at least part of their respective end turn sections 36 and 46. As a result of the juxtaposition, the coils are cross coupled in part along their positive polarity area, shown as 72 in FIG. 9, as well as along their negative polarity areas 70. By correctly positioning the two coils 32 and 42, and in particular by overlapping the end turn sections 36 and 46 thereof by the required extent, it is possible to substantially eliminate the cross coupling by providing equal amounts of coupling in-phase and 180 degrees out-of-phase.

An embodiment of the invention is shown in cross section in FIGS. 11 and 12. The auxiliary deflection yoke includes a horizontal deflection coil 106 and a vertical deflection coil 108, both disposed to the rear of the primary deflection yoke along the tube. FIG. 11 is a cross section through the center line of the deflection apparatus showing the upper half of the deflection apparatus, a mirror image of the configuration shown being provided on the lower side. The auxiliary horizontal deflection coil 106 has a flat, front end turn section 46 at a forward end of the auxiliary deflection coil 106. The primary horizontal deflection coil 102 has a flat, rear end turn section 35 at a rear end. The sections of the primary and auxiliary deflection coil are at least partly overlapped, namely by the amount needed to cancel the effects of cross coupling by coupling the coils at both positive and negative polarity, in a balanced manner. The particular extent of overlap depends in part on the geometry of the elongated sections 36 and 46. Adjustment means (not shown) can be provided, for example axially oriented screws attaching the respective primary and auxiliary coils to one another or to a yoke housing such that the exact overlap needed for cancelling cross coupling can be obtained adjustably.

A similar overlapping arrangement is provided for the vertical coils 104 and 108 of the primary and auxiliary deflection yokes, respectively. The overlap can be seen in FIG. 12, which shows a cross section in the area of the overlap. The axial ends of the coils which face away from the area of overlap can be provided with turned up end turns. Except for the particular ones of the end turns which are overlapping ends of the coils, the coils can be arranged in a known manner.

The overall deflection system provided by the invention is substantially shorter along the Z axis than a comparable configuration that does not use inventive concepts, as will be apparent from a comparison of FIGS. 10 and 11. While the arrangement of FIG. 10 is characterized by spacing of the primary coils 84, 86 from the auxiliary coils 88, 92, as well as the use of a flux confining element 94, the overlapped arrangement of the invention illustrated in FIG. 11 is shorter than the individual lengths of the primary and auxiliary coils. The focal length of the deflection system as a whole is short, as is the overall length along the Z axis, whereby a shorter picture tube is made possible. In addition, the precision of primary and auxiliary deflection is improved.

What is claimed is:

1. A deflection coil system, comprising:

a primary deflection coil having a longitudinal electron beam axis and, operable to produce an electron beam deflection field having a first polarity within a first region defined by the coil and an opposite polarity in a second region;

an auxiliary deflection coil, also operable to produce an electron beam deflection field having said first polarity in a first region and said opposite polarity in a second region; and wherein, the primary deflection coil and the auxiliary deflection coil are juxtaposed coaxially with the electron beam axis such that each of two polarity regions of the primary deflection coil interacts with a corresponding one of the two polarity regions of the auxiliary deflection coils to substantially cancel cross coupling of the primary and auxiliary deflection coils.

2. The deflection coil system according to claim 1, wherein the primary and auxiliary deflection coils are deflection coils of a television display tube, and wherein the cross coupling of the primary and auxiliary deflection coils results at least partly from proximity of the primary and auxiliary coils on the tube.

3. The deflection coil system according to claim 2, wherein at least one of the primary and auxiliary deflection coils is a saddle shaped deflection coil.

4. The deflection coil system according to claim 3, wherein at least one of the primary deflection coil and the auxiliary deflection coil has a flat end turn section, substantially defining the opposite polarity area, and wherein the primary and auxiliary deflection coils are overlapped on the tube over at least part of the end turn section to thereby cross couple part of the positive polarity areas and all of the opposite polarity areas.

5. A television display tube deflection coil system, comprising:

a saddle shaped primary deflection coil and an auxiliary deflection coil having a forward flat end turn section, said primary deflection coil operable to produce an electron beam deflection field having a first polarity within a first region defined by that coil and an opposite polarity in a second region, said auxiliary deflection coil also operable to produce an electron beam deflection field having said first polarity in a first region and said opposite polarity in a second region that is substantially defined by its flat end section;

said auxiliary deflection coil being positioned along a tube axis to the rear of said primary deflection coil with said flat end turn section partially overlapping said primary deflection coil to thereby cross couple part of the first polarity field regions and all of the opposite regions for substantially cancelling cross coupling between the primary and auxiliary deflection coils.

6. The deflection coil system according to claim 5, wherein the primary deflection coil also has a flat end turn section, the end turn sections of the primary and auxiliary deflection coils being at least partly overlapped.

7. The deflection coil system according to claim 5, wherein the primary deflection coil is a saddle shaped coil provided with a flat end turn section, the primary and auxiliary deflection coils being mountable successively on the tube so as to overlap at least partially in the area of the respective flat end turn sections.

8. The deflection coil system according to claim 7, wherein the flat end turn sections of the primary and auxiliary deflection coils are disposed on facing ends thereof, whereby the primary deflection coil is mountable against a funnel-shaped envelope of a television tube and the auxiliary deflection coil is mountable on a neck of the tube, partially overlapping the primary deflection coil at the flat end turn sections.

9. The deflection coil system according to claim 8, comprising a primary deflection yoke that includes horizontal deflection coils of the first type and vertical deflection coils of the second type and an auxiliary deflection yoke that includes horizontal deflection coils of the first type and vertical deflection coils of the second type, each of said horizontal deflection coils and vertical deflection coils oriented to produce a magnetic field in axes perpendicular to an axis of the electron beam, and wherein each of said primary first and second coils has at least one negative polarity section coupled to one of said first and second auxiliary coils.

10. The deflection coil system according to claim 9, wherein each of said yokes has coils in two mutually perpendicular axes perpendicular to said axis of the electron beam.

11. A scanning electron beam display, comprising:

a tube defining a neck and an envelope, at least one electron gun being disposed in a neck of the tube and operable to produce a beam of electrons to be accelerated through the neck and through the envelope toward a display surface at an opposite end of the tube;

at least one primary deflection coil for deflecting said beam in at least one of two mutually perpendicular directions on the display surface, the primary deflection coil having a saddle shaped configuration and being mounted on the envelope of the tube, for producing a primary magnetic field perpendicular to the beam of electrons;

at least one auxiliary deflection coil having a saddle shaped configuration and being mounted on the neck on a common axis with the primary deflection coil, the auxiliary deflection coil producing an auxiliary magnetic field substantially parallel to that of the primary deflection field, centered at a point spaced therefrom along the common axis;

at least one of said primary and auxiliary deflection coils being arranged to produce a magnetic field of a first polarity in the tube and a supplemental field of an opposite polarity at an end of the coils along the axis of the tube, said primary and auxiliary deflection coils being mounted relative to one another on the tube such that the supplemental field of said coil couples to the other coil, whereby coupling between said primary and secondary deflection coils at the first polarity is substantially cancelled.

12. The display according to claim 11, wherein at least one of the primary deflection coil and the auxiliary deflection coil has a flat end turn section, substantially producing the supplemental field at the opposite polarity, and wherein the primary and auxiliary deflection coils are overlapped on the tube over at least part of the flat end turn section.

13. The display according to claim 12, wherein the auxiliary deflection coil is disposed to the rear of the primary deflection coil along the tube, and the auxiliary deflection coil has said flat end turn section adjacent a forward end of the auxiliary deflection coil.

14. The display according to claim 13, wherein the primary deflection coil also has a flat end turn section, the end turn sections of the primary and auxiliary deflection coils being overlapped.

15. The display according to claim 11, further comprising primary and auxiliary vertical deflection coils oriented to produce magnetic fields for deflecting said beam in the other one perpendicular direction, and wherein each of said vertical coils has at least one negative polarity section coupled to the other one vertical coil.

16. The display according to claim 11, wherein at least some of the primary deflection coils and the auxiliary deflection coils have a flat end turn section, overlapped with a flat end turn section of another of said primary deflection coils and said auxiliary deflection coils, said end turn sections substantially defining respective opposite polarity areas of said coils.

17. A deflection yoke arrangement, comprising:

a first deflection coil located along the longitudinal axis of a cathode ray tube and operable to provide a first deflection field inside said tube for deflecting an electron beam that is traveling inside said tube toward the viewing screen;

a second deflection coil located along said longitudinally axis and displaced longitudinally from said first deflection coil and operable to provide a second deflection field inside said tube for providing additional deflection of said electron beam, wherein the two deflection coils are positioned along the longitudinal axis to provide an overlap of a rear end turn section of one of the coils with a front end turn section of the other coil.

18. An arrangement according to claim 17 wherein each of the coils is saddle shaped, with at least one of the rear end turn section of said one coil and the front end turn section of the other coil being of a flattened construction.

19. An arrangement according to claim 18 wherein both of the aforementioned end turn sections are of the flattened construction.

20. A arrangement according to claim 19 wherein said first and second deflection coils each are of either the horizontal or vertical deflection type.

21. An arrangement according to claim 17 wherein said one coil is said first coil, wherein the first deflection field has a first polarity within a first region defined by the rear end turn section and an opposite polarity in a second region, wherein the second deflection field has a first polarity within a first region defined by the front end turn section and an opposite polarity in a second region, said overlap resulting in the superimposing of respective polarity regions of the two coils in a manner which substantially cancels cross coupling of the two coils.

22. A arrangement according to claim 19 wherein said first and second deflection coils each are of either the horizontal or vertical deflection type.

23. An arrangement according to claim 17 wherein each of the coils is saddle shaped with, at least one of the rear end turn section of said one coil and the front end turn section of the other coil being of the flattened construction.

24. An arrangement according to claim 23 wherein both of the aforementioned end turn sections are of the flattened construction.

25. An arrangement according to claim 24 wherein said one coil is said first coil, wherein the first deflection field has a first polarity within a first region defined by the rear end turn section and an opposite polarity in a second region, wherein the second deflection field has a first polarity within a first region defined by the front end turn section and an opposite polarity in a second region, said overlap resulting in the superimposing of respective polarity regions of the two coils in a manner which substantially cancels cross coupling of the two coils.

* * * * *